United States Patent [19]

Rosenberger

[11] Patent Number: 4,757,777

[45] Date of Patent: Jul. 19, 1988

[54] ULTRALIGHT WATERBORNE VESSEL AND SAIL

[76] Inventor: John R. Rosenberger, 133 Hayes Pl., Centerport, N.Y. 11721

[21] Appl. No.: 15,911

[22] Filed: Feb. 18, 1987

[51] Int. Cl.[4] ..... B63B 1/14; B63H 9/04

[52] U.S. Cl. ..... 114/39.1; 114/61; 114/103

[58] Field of Search ..... 114/39.1, 39, 61, 102, 114/103, 165; 440/67

[56] References Cited

U.S. PATENT DOCUMENTS

| | | | |
|---|---|---|---|
| 2,987,736 | 6/1961 | Wolff | 440/107 |
| 3,395,664 | 8/1968 | Greenberg et al. | 114/39 |
| 3,658,028 | 4/1972 | Koons | 440/67 |
| 3,691,976 | 9/1972 | Wilson | 114/39 |
| 4,227,480 | 10/1980 | Carras | 114/61 X |
| 4,524,709 | 6/1985 | McKenna | 114/39.1 |
| 4,543,899 | 10/1985 | Walker | 114/39 |
| 4,690,086 | 9/1987 | McKenna | 114/61 X |

FOREIGN PATENT DOCUMENTS

| | | | |
|---|---|---|---|
| 2508377 | 9/1976 | Fed. Rep. of Germany | 114/39.1 |
| 1423958 | 12/1966 | France | 114/39.1 |
| 2457212 | 1/1981 | France | 114/39.1 |

*Primary Examiner*—Sherman D. Basinger

[57] ABSTRACT

A colapsible light and strong vessel adapted for movement over water having a substantially terahedral frame comprising three elongated rigid members each connected to a buoyant hull and which meet at a common juncture, the hulls are configured such that one hull is forward and the other two aftward, a fourth rigid member projects upwardly from this juncture, A plurality of stays are connected proximal to the distal ends of these four members. A fifth member is connected to the two aft members proximal to the the aft hulls, this fifth member may serve as a stay, decking is connected to this aft member and to the common juncture. An engine is connected proximal to the forward hull. A light weight sail is provided which comprises a plurality of elongated airfoil shaped surfaces.

36 Claims, 7 Drawing Sheets

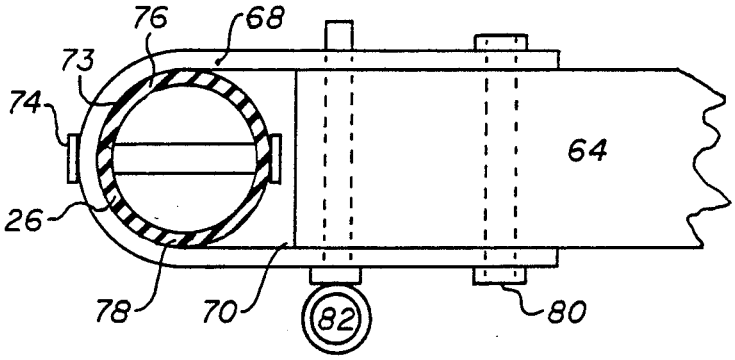
FIG. 7
FIG. 1
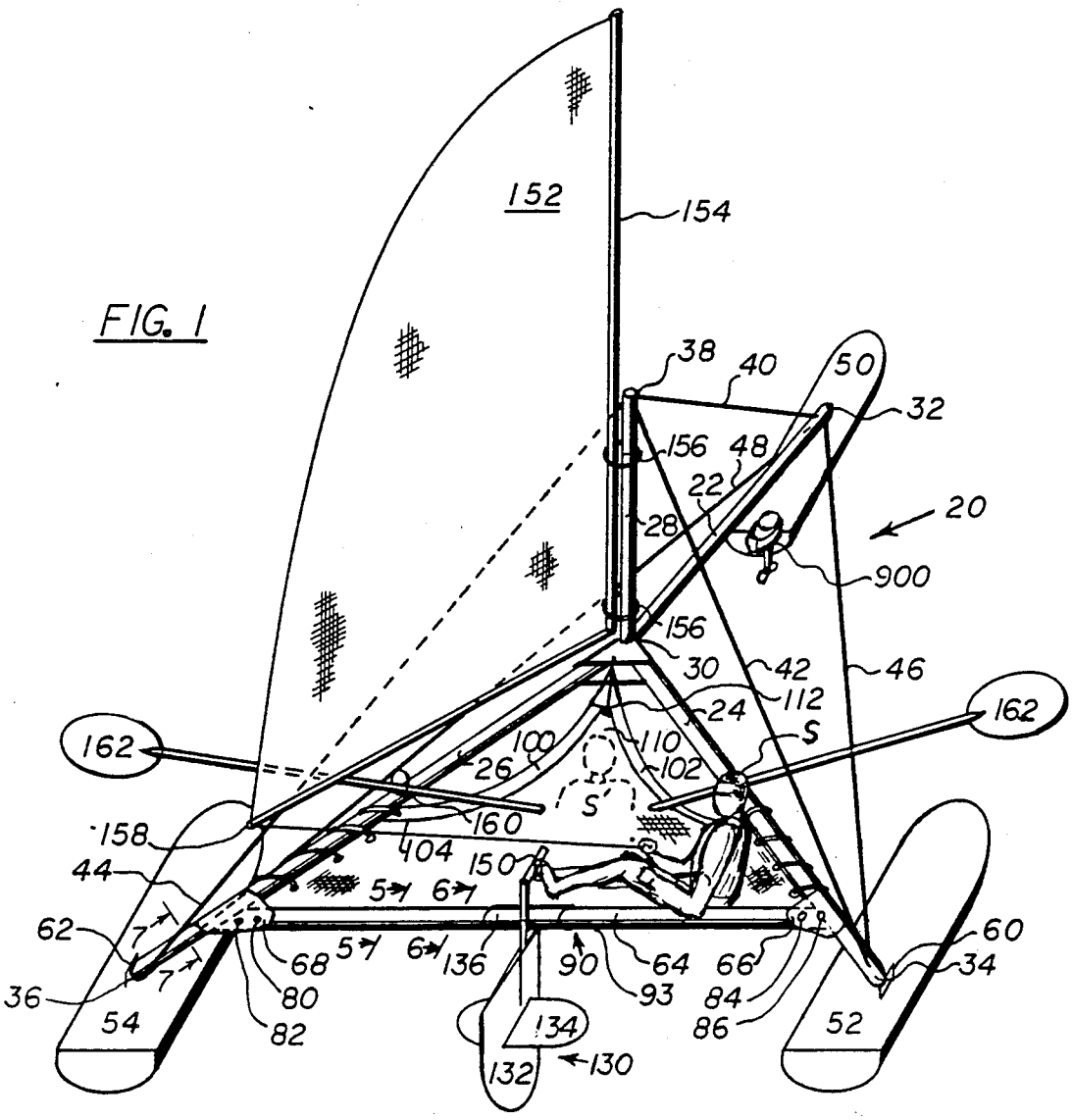

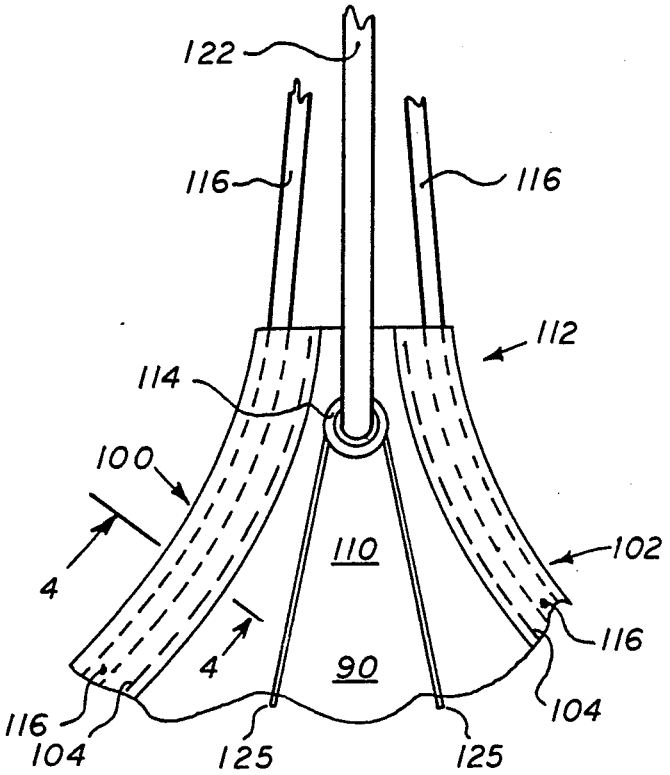
FIG. 3
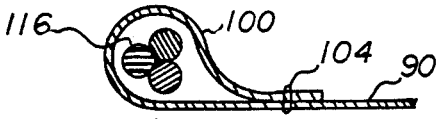
FIG. 4
FIG. 5
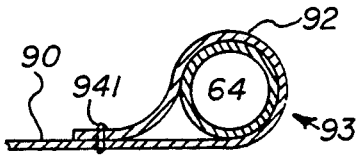
FIG. 6
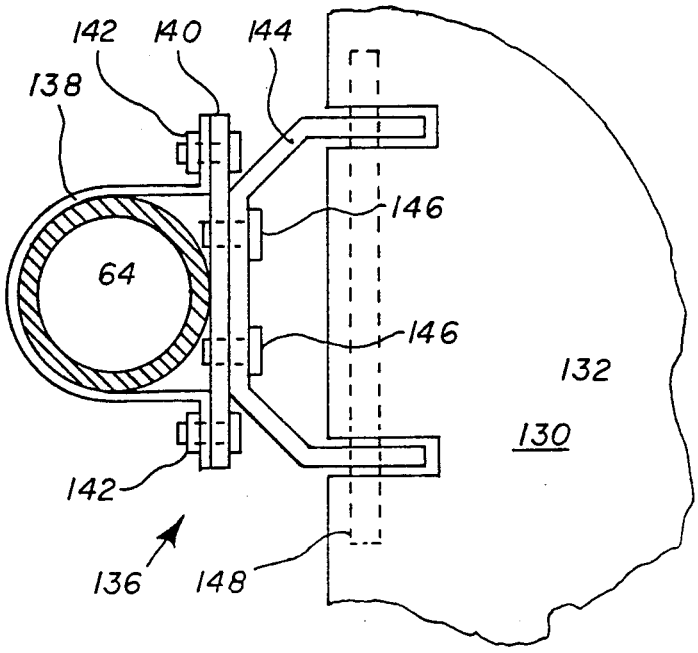

ULTRALIGHT WATERBORNE VESSEL AND SAIL

BACKGROUND OF THE INVENTION

The present invention relates to marine vessels, particularly sailing vessels, and also relates to sail assemblies for sailing vessels.

Boats have been provided heretofore with multiple. spaced-apart hulls or pontoons, the common catamaran and trimaran being typical examples of this approach. Various proposals have been advanced heretofore to employ tetrahedral space frames in construction of multi-hulled sailboats. These tetrahedral space frames typically include a plurality of elongated struts and an elongated mast extending outwardly from a central juncture. The mast extends upwardly from the central juncture, whereas the struts extend outwardly and downwardly from the juncture. Thus, the ends of the mast and of the struts remote from the juncture define the vertices of a tetrahedron. Additional bracing elements interconnect the ends of the struts and mast remote from the juncture, so that these additional elements extend generally along the edges of the tetrahedron. These elements cooperate with the mast, struts and other elements of the vessel to provide a rigid space frame. Pontoons are attached to the strut ends at the three lowermost vertices of the tetrahedron.

Tetrahedral space frame structures of this general nature are disclosed, for example, in U.S. Pat. No. 3,572,740 for use in land yachts and ice boats, and in U.S. Pat. Nos. 3,831,539; 3,991,694; 4,333,412; 4,316,424; 3,631,828 and 4,524,709 for use in water craft. Experiments with another tetrahedral space frame sailboat are described in the article "Amaran, The Mad Hatters Tea Cup At A Gallop!", MULTIHULLS Magazine, July/August 1985, pp. 47–48. Certain of these tetrahedron space frame sailing vessels have provided a basket like enclosure hanging from the space frame beneath the juncture of the spars and mast for occupancy by the crew. Others, as shown in the aforementioned U.S. Pat. Nos. 4,524,709 and 3,572,740 have utilized a sheetlike deck strung beneath the tetrahedral space frame. The tetrahedral space frame concept would appear to have great promise, especially in connection with water-borne sailing vessels. Because the structure is supported at widely spaced apart points on the water surface, it has good stability in rough seas, and extraordinary resistance to the heeling moments caused by wind engaging the sails. Moreover, the mast utilized in the structure of the vessel itself can also serve as part of a sail supporting structure. The basic nature of the tetrahedral space frame would appear to provide good strength for a given weight and size.

The promise of the tetrahedron space frame concept, however, has not been effectively realized heretofore. Tetrahedral space frame sailing vessels heretofore typically have not achieved particularly good strength-to-weight ratios, and typically have been most uncomfortable and inconvenient. Notably, in the case of lightweight sporting and racing sailing vessels for carrying a crew of one or two persons, tetrahedron space frame sailing vessels simply have not been competitive with more conventional monohull and multihull designs. Despite the great theoretical promise of the tetrahedron space frame, the conventional monohull and multihull designs typically have been faster, easier to sail and decidedly more comfortable.

Another theoretically promising concept in sailing vessel development has been the use of multiple, blade-like sails. As disclosed in U.S. Pat. No. 1,504,057, greater propulsive force per unit sail area can be obtained with a large number of elongated, vertically extensive blade-like sails than with a single sail of conventional shape. This concept has been pursued for many years, and is described in more modern form in U.S. Pat. Nos. 4,465,008 and 4,453,483. Typically, the multiple sail blades are arranged in framework of horizontal bars or yards, so that the blades extend vertically between these horizontal bars or yards, or else extend between a single horizontal bar or yard at the top of the assembly and the vessel hull itself. Each blade ordinarily includes framework or beam elements extending along the length of the blade. Typically, the loads imposed by the wind on the blade-like sails are transmitted through the framework or beam elements in the blades to the bars or yards and to the vessel itself.

The multiblade sail concept in theory appears to offer significant performance advantages. Here again, however, the theoretical promise has not been realized in practice. Multiblade sails simply have not been competitive in performance with conventional sails when used on a real boat. Ordinarily, the added weight of the framework in the blades and the associated structures more than offsets any performance gain attainable through the multiblade concept. Moreover, the added weight imposed by the multiblade sail concept is carried far above the center of gravity of the boat, and hence is troublesome with respect to stability, sailing qualities and the like and requires still further added weight in masts or other supporting structures.

Thus, despite the theoretical teachings in the art regarding tetrahedral space frame structures and multiblade sails, there have been needs heretofore for further improvement in vessels and sail assemblies.

SUMMARY OF THE INVENTION

The present invention provides vessels and sail assemblies which address those needs.

One aspect of the present invention provides a vessel having a tetrahedral space frame which includes two elongated aft struts, an elongated forward strut and an elongated mast, each having a juncture end and a distal end. Connecting means are provided for attaching the juncture ends of the mast and struts to one another to form a common juncture so that the struts project outwardly and downwardly from the juncture, the mast projects upwardly from the juncture and the distal ends of ths struts and mast define the vertices of a tetrahedron. The vessel also includes a forward pontoon and two aft pontoons. Portion connecting means are provided for connecting the forward and aft pontoons to distal end regions of the forward and aft struts, respectively, adjacent the distal ends of those struts so that the pontoons will support the frame on the water surface. Propulsion means are provided for moving the frame along a surface. Preferably the propulsion means include means for attaching a sail to the mast or to another portion of the frame.

A vessel according to this aspect of the invention, most preferably includes an elongated, substantially rigid crossbeam. Crossbeam connecting means are provided for connecting the opposite end regions of the crossbeam to the other elements of the vessel adjacent the connections between the aft and the aft pontoons, so that the crossbeam extends generally in a beamwise, lateral direction across the frame. The frame also includes stay means such as cables for connecting the distal end region of the mast to the distal end regions of each of the struts, and for connecting the distal end region of the forward strut to the distal end regions of each of the aft struts. The frame desirably is arranged to be readily disassembled or collapsed for storage, transportation or the like.

Preferably, the only elements apart from the struts themselves interconnecting the distal end regions of the struts with one another are flexible cables interconnecting the forward strut with the aft struts and the crossbeam. Likewise, the distal end region of the mast is connected to the distal end regions of the struts only by flexible cables. Thus, the entire tetrahedral structure preferably is made up of the mast, struts, crossbeam and cables, together with any fitting used to attach the ends of these elements to one another. Most preferably, only three struts, one mast, one crossbeam and five cables are used. This gives an extraordinary light and strong structure.

The crossbeam not only serves to brace the structure, but also allows the crew to move between the sides of the vessel. Thus, the crossbeam will support the weight of a sailor as the sailor moves across the vessel. The remainder of the vessel structure preferably does not substantially obstruct such movement. Preferably, the vessel also includes a deck and means for connecting the deck to the crossbeam. The deck may extend forwardly from the crossbeam and may include a forward attachment point disposed forwardly of the crossbeam but aft and beneath the juncture of the struts and mast. The deck connecting means may also include forward attachment means for connecting the forward attachment point of the deck to a portion of the frame adjacent the juncture.

The deck can be rigid, and can be formed integrally with the crossbeam and thus connected to the crossbeam. In a particularly preferred arrangement, the deck is flexible and sheetlike, and the deck connecting means is arranged to connect an elongated rear edge of the deck to the crossbeam so that the rear edge of the deck extends along the crossbeam, and to connect the deck to the frame at further locations forward of the crossbeam. The forward attachment means may include a tension element adapted to pull the forward attachment point on the sheetlike deck forwardly and upwardly, towards the juncture of the mast and struts, thus keeping the deck under tension. In a particularly preferred arrangement, the deck has a generally trapezoidal main portion bounded on two sides by opposed lateral edges extending forwardly from the rear edge and crossbeam, the lateral edges sloping towards one another. The deck connecting means preferably includes lateral attachment means for securing each of the lateral edges to one of the aft struts.

Preferably, the lateral attachment means includes a rope, cable or other elongated flexible lashing element arranged so that one lateral edge of the deck is lashed to the adjacent aft strut by one portion of the flexible member and the opposite lateral edge is lashed to the other aft strut by another portion of the lashing element. A middle portion of the lashing element preferably extends across the deck and projects forwardly from the deck to the juncture of the mast and struts. Tension in this lashing element thus also tensions the sheetlike deck. The deck itself may include a tubular guide, which may be defined by folds in the sheetlike deck material, extending from the lateral edges to the vicinity of the forward attachment point for guiding the lashing element and transmitting forces from the lashing element to the deck itself. These tubular guides may extend along the forward edge of the deck, and most preferably are curved so that they cooperatively define a point or cusp projecting forwardly from the main portion of the deck. This arrangement provides a sound, light, simple and effective way of further tensioning the deck.

In the preferred arrangements, the main portion of the deck provides a comfortable crew platform adjacent the crossbeam. Typically, a single sailor operates the vessel, and he can position himself adjacent either aft pontoon, facing inwardly towards the center of the boat, in a natural comfortable position for controlling the sails. Preferably, the rudder controls are mounted for access from this position. In a particularly preferred arrangement, the rudder is attached to the aft crossbeam, so that a simple arrangement such as a conventional tiller provides good controllability from the sailing positions afforded by the deck. Moreover, the deck allows the sailor to sit facing rearwardly, adjacent the centerline of the vessel, between the aft struts. Appropriate means such as oarlocks on the aft struts may be provided for mounting oars to the frame. A sailor in the rearward facing position afforded by the deck is ideally supported for rowing the vessel. This provides a very significant convenience and a safety enhancement vis-a-vis prior tetrahedral space frame vessels, which are almost impossible to row or paddle upon loss of sails upon becalming or for manuevering in close quarters.

The forces imposed by the sailer on the deck, such as weight and acceleration loads, are transmitted by the deck primarily through the lateral and rear edges. With the sailor in a sailing position, substantial portions of these loads are transmitted through the rear edge of the deck to the aft crossbeam through the crossbeam to the distal regions of the aft struts, and directly through the lateral edges of the deck to the distal regions of the aft struts. This arrangement minimizes bending moments on the struts caused by the sailors weight and by the sailors mass as the boat accelerates in the typical pitching or rocking motion during use. Moreover, the forces imposed by the sailer on the deck do not create significant buckling or bending loads on the struts. Any tendency of the two aft struts to move towards one another under the influence of tension in the deck is resisted by the crossbeam, serving as a compression member. Because the rear edge of the deck and preferably the lateral edges as well are effectively supported above the water surface by the crossbeam and aft struts, and because the forward attachment point is pulled upwardly by the tensioning member toward the juncture of the frame, only moderate tension need be applied to the deck to maintain the sailor above the water surface. By contrast, in the so-called "trampoline" type deck proposed herefore, substantial tension load would be necessary to support the sailor's weight, and these tension loads would be directly translated into buckling and bending forces on the struts.

The preferred vessels according to this aspect of the invention thus provides a combination of convenience, structural integrity and strength-to-weight ratio heretofore lacking in tetrahedron space frame vessels. This aspect of the present invention thus makes it possible to realize the full potential of the tetrahedron space frame in a practical sailing vessel. The advantages of this aspect of the invention are especially pronounced in the case of light vessels, suitable for carrying a crew of one, two or three persons, and most particularly in vessles suitable for carrying a solo sailor. Vessels according to this aspect of the present invention may have weight comparable to the weight of a sailing surfboard or the like, but can effectively carry sail areas equivalent to those of a large multipassenger cruising sailboat. Moreover, the vessels according to this invention provide rough sea performance superior to those of the large cruising sailboats.

A further aspect of the present invention provides an improved sail assembly. A sail assembly according to this aspect of the present invention includes two or more elongated spars and spar securement means for securing the spars to a sailing vessel so that theses spars extend generally horizontally, preferably substantially parallel to one another. A plurality of elongated blades are provided. The length of each blade typically exceeds the distance between the spars. Blade attachment means are provided for connecting each of the blades to both of the spars so that the blade extend substantially vertically and so that each of the blades project upwardly and downwardly beyond the spars. Thus, the spars are arranged so that the spars are disposed between the ends of the blades. Accordingly, the bending stresses in the structural elements of the airfoil blades are typically about one fifth of those encountered in comparable multiblade sail assemblies according to previously proposed designs, where the air foil blades are supported at the ends of the blades. This aspect of the present invention thus provides a substantial reduction in the weight of the blades themselves. Moreover, the spar arrangements utilized in sail assemblies according this aspect of the present invention are themselves substantially lighter than the complex frames herefore proposed for multi blade sails. In particular, the spars are relatively close together and hence can be interconnected with one another by relatively short and lightweight elements. In preferred arrangements, elements of the blades themselves may interconnect the spars. The improvements provided by this aspect of the present invention make it practical to employ multiblade sail assemblies and to achieve the performance advantages heretofore regarded as only theoretical possibilities.

The most preferred sail assemblies according to this aspect of the invention utilize only two spars as described above, and these spars are located at particular locations along the length of the bladelike sails. Thus, each of the blades should protrude above and below the spars by a protrusion distance equal to between about 15% and about 25% of the length of the blade, preferably between about 20% and about 21.4% of the blade length, and most preferably equal to about 20.7% of the blade length. These particular protrusion distances, and especially the most preferred 20.7% protrusion distances, provide the minimum weight structure attainable, and provide surprisingly good results. In a less preferred arrangement, three spars may be provided, and these may be arranged so that the protrusion distance of each blade above the uppermost spar and below the lowermost spar is between about 5% and about 15% of the blade length, preferably between about 9% and about 10% of the blade length, and most preferably about 9.48% of the blade length. Most preferably, in a three-spar structure, the middle spar is equidistant between the uppermost and lowermost spars. These particular dimensions provide enhanced load carrying capacity in the blades and hence permit use of a very light sail assembly to provide large sail areas and large aggregate leading edge lengths.

Preferably, each of the blades is pivotally mounted to the spars so that the blade is free to pivot with respect to the spars about a vertical blade pivot axis adjacent the leading edge of the blade. In particularly preferred constructions, each blade includes a vertically extensive forebeam, a vertically extensive aftbeam, and a flexible covering extending around these beams. The forebeam of each blade may serve as the blade pivot axis.

According to a further aspect of the invention, the spars may be pivotally connected to the vessel so that the spars can swing about generally horizontal, beamwise spar pivot axes. Each blade may also be mounted to the spars so that the blade can pivot with respect to each spar about an articulation axes substantially parallel to the spar pivot axes, in addIition to its pivoting motion about the blade pivot axis. Each blade may be provided with a link connecting a point on the blade remote from the blade pivot axis with a point on the spar also remote from the blade pivot axis. As further explained below, the blades, spars and links act as a three-dimensional space linkage so that the crew can control the range of pivoting motion of the blades about the blade pivot axes simply by tilting the spars about the spar pivot axes. This allows the crew to adjust the blades to changing wind conditions without complex arrangements of lines or control devices. Moreover, the entire sail assembly can fold to a width approximately equal to the width of a single blade for storage and transport.

These and other objects, features and advantages of the present invention will be more readily apparent from the detailed description of the preferred embodiments set forth below, taken in conjunction with the accompanying drawings.

BRIEF DESCRIPTION OF THE DRAWINGS

FIG. 1 is a schematic perspective view of a sailing vessel according to one aspect of the present invention, also shown is an auxiliary outboard motor.

FIG. 3 is a detailed view of an enlarged scale of a portion of the vessel shown in FIGS. 1 and 2.

FIG. 4 is a sectional view taken along line 4—4 in FIG. 3.

FIGS. 5, 6 and 7 are fragmentary sectional views on an enlarged scale taken along lines 5—5, 6—6 and 7—7 in FIG. 2.

DETAILED DESCRIPTION OF THE PREFERRED EMBODIMENTS

Figure 2:
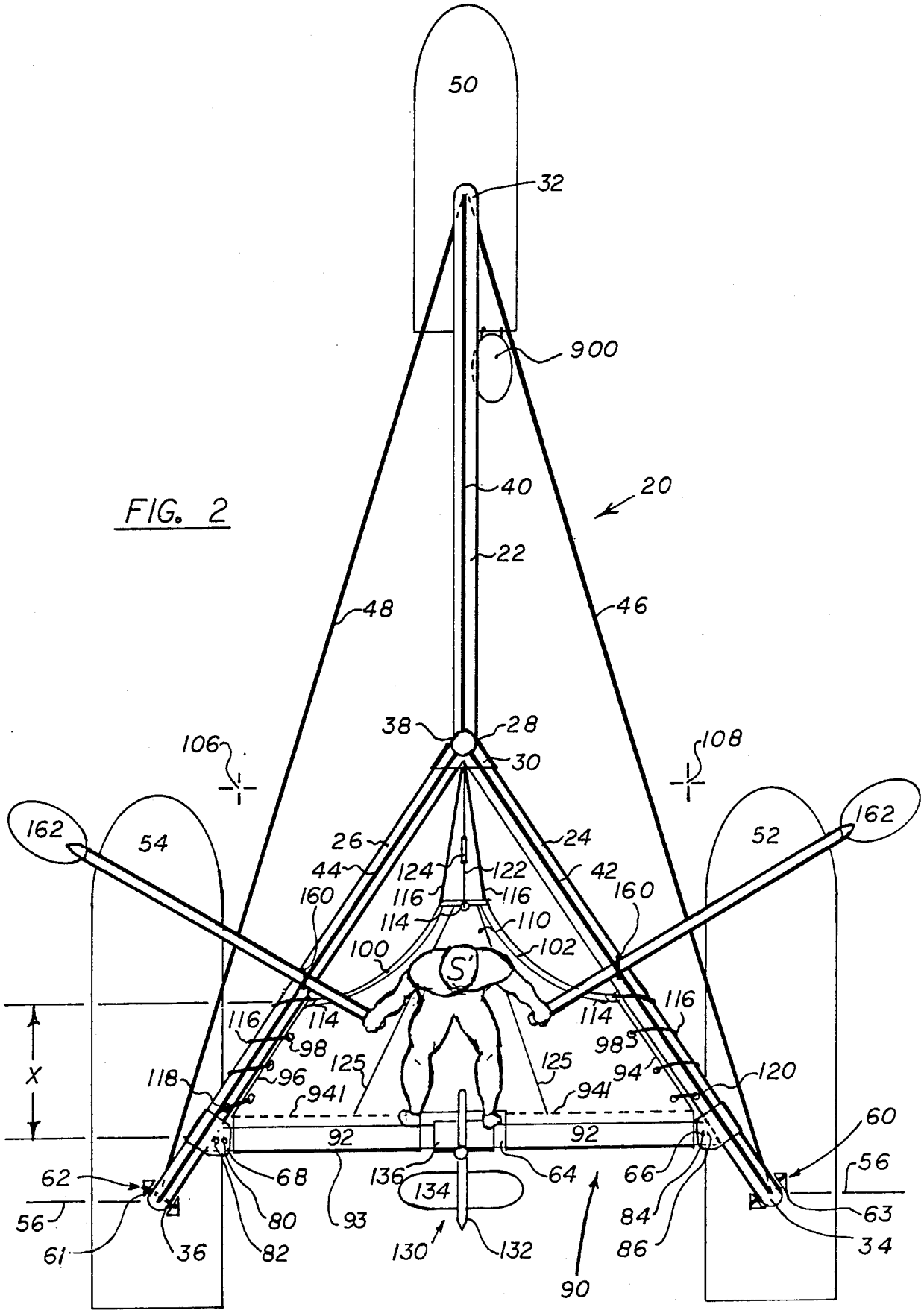
FIG. 2 is a top view of the vessel shown in FIG. 1.

A vessel according to one embodiment of the present invention includes a frame 20 (FIG. 1) incorporating a forward strut 22, two aft struts 24 and 26 and a mast 28. These elements are joined to one another so that juncture ends of the struts and mast come together at a common juncture 30. Forward strut 22 projects downwardly and forwardly from juncture 30, aft strut 24 projects downwardly, rearwardly and to the starboard side of the vessel from juncture 30 whereas aft strut 26 projects downwardly, rearwardly and to the port side of the vessel from juncture location 30. The distal ends 32, 34 and 36 of spars 22, 24 and 26, and the distal end 38 of mast 28 define the vertices or corners of a tetrahedron.

The frame also includes flexible cable stays 40, 42 and 44 extending from the distal end region of mast 28, adjacent distal end 38 to the distal end region of each spar, so that the cables 30, 42 and 44 extend along three edges of the tetrahedron defined by the frame. A further cable stay 46 extends from the distal end region of forward strut 22 to the distal end region of starboard and aft strut 24, and yet another such stay 48 extends from the distal end region of forward strut 22 to the distal end region of port aft strut 26.

Appropriate means (not shown) are provided for tensioning the stays. Preferably, the frame elements are releasably connected to one another so that they may be disassembled or collapsed for storage or transport. For example, the struts may be connected to one another by a bolt extending downwardly from the juncture or bottom end of mast 28 through the juncture ends of the struts, and appropriate means may be provided for jacking the mast upwardly relative to the struts so that the mast pulls on stays 42, 40 and 44. This pulls the distal ends of spars 22, 24 and 26 upwardly, thereby tensioning stays 46 and 48 as well. Thus, a single convenient adjustment preloads the entire vessel structure to substantially eliminate any play or relative motion between the parts of the vessel.

Pontoons 50, 52 and 54 are attached to the distal ends 32, 34 and 36 of the struts. An auxiliary outboard motor 900 is located proximal to pontoon 50. The aft pontoons 54 and 52 are mounted to the aft struts so that each of these pontoons is pivotable about a beamwise axis 56 (FIG. 2) with respect to the associated strut. The pontoons 52 and 54 may be connected to the distal ends 34 and 36 of the aft struts by clevis assemblies 60 and 62, respectively, at the distal ends of the aft struts. Preferably, each clevis assembly 60 and 62 includes a pin (not shown) extending along beamwise axis 56, and through a mating knuckle 61 and 63 on the associated pontoon 52 and 54. Each such pin preferably is removable so that the aft pontoons can be detached from the aft struts for storage.

An elongated, substantially rigid, tubular crossbeam 64 extends between the distal end regions of the aft struts 24 and 26, so that the crossbeam defines the lower aft edge of the tetrahedral structure and so that crossbeam 64 and aft struts 24 and 26 cooperatively define a triangle. Crossbeam 64 is connected to the distal end regions of the aft struts by a pair of yokes 66 and 68. As best seen in FIG. 7, yoke 68 defines a generally U-shaped slot 70 which is co-planar with both cross beam 64 and struts 26. Thus, slot 70 extends generally in the plane of the triangle defined by the aft struts and crossbeam. The bight 73 defined by U-shaped yoke 68 extends around the outside of strut 26, and the yoke is fastened to strut 26 by one or more fasteners 74 extending through the bight. Fasteners 74 extend through the wall of tubular strut 26 adjacent the medial plane of the strut. The uppermost region 76 and lowermost region 78 of the strut 26 are not penetrated by any fasteners securing the yoke to the strut. Thus, the fasteners penetrate the tubular strut only adjacent the neutral plane of the strut with respect to vertical bending loads.

Crossbeam 64 is connected to yoke 68 by a permanent fastener 80 and a releasable fastener 82, both extending through the upper and lower surfaces of the yoke and through crossbeam 64. The connection between the other yoke 66 and the other aft strut 24 is substantially the same, and the connection between the other end of the crossbeam 64 and yoke 66 is also similar to the connection between yoke 68 and crossbeam 64. However, two removable fasteners 84 and 86 secure crossbeam 64 to yoke 66. Removable fasteners 82, 84 and 86 may be standard marine cam-lock pins. Those pins per se are well known to those of ordinary skill in the art and are commonly used for fastening other marine hardware. Cam-lock pins can be installed and removed without the use of any tools. As best appreciated with reference to FIG. 2, upon removal of pins 84, 86 and 82, the crossbeam 64 can swing upwardly and to the port side as seen in FIG. 2 about fixed pin 80 and hence can fold towards port aft strut 26 for storage.

A flexible deck 90 is mounted to the frame and crossbeam 64 is the triangular opening defined by struts 24 and 26 and cross member 64. Flexible deck 90 is formed from a flexible sheetlike material such as Kevlar nylon, dacrons canvas, plastic sheeting or the like, nylon fabric being particularly preferred for strength and light weight. Deck 90 has a pair of elongated pockets 92 defining a rear edge 93. As shown in FIG. 5, each pocket 92 is formed by a fold in the fabric of the deck, which is secured by stitching 941 extending parallel to rear edge 93. Deck 90 also has a pair of opposed lateral edges 94 and 96 extending forwardly from the rear edge 93 so that the lateral edges 94 and 96 and the rear edge 93 cooperatively define a generally trapezoidal main portion of the flexible deck. A row of lashing grommets 98 is provided along each of lateral edges 94 and 96.

The flexible deck 90 also has a pair of curved tubular guides 100 and 102 extending inwardly and forwardly from the forward ends of lateral edges 94 and 96, respectively. As seen in FIGS. 3 and 4, each of these tubular guides 100 and 102 is formed by a fold in the fabric of deck 90 secured by stitching 104 extending along the guide. Tubular guides 100 and 102 are concave, having centers of curvature approximately at the locations denoted 106 and 108, respectively, the centers of curvature being disposed away from the longitudinal fore and aft centerline of the vessel and also forwardly of deck 90. Thus, tubular guides 100 and 102 define inwardly extending forward edge regions bounding the trapezoidal main portion of deck 90 and also define a projection 110 extending forwardly from the trapezoidal main portion, the projection terminating at a cusp or point 112. A grommet 114 extends through the flexible deck at a forward attachment point adjacent cusp 112.

The rear edge 93 of the deck extends along crossbeam 64, the rear edge being secured to the crossbeam by pockets 92, which receive the crossbeam. A flexible but substantially inextensible rope or lashing member 116 is secured at one end to a jam cleat 118 on port aft strut 26 and is laced around the distal end region of the aft strut and through the grommets 98 in the adjacent lateral edge 96 of deck 90. The same rope or lashing member 116 continues through tubular guide 100, forwardly and upwardly to the frame juncture 30, back from juncture 30 to guide 102, through guide 102. The end portion of lashing member 116 extending along edge 94 is wrapped around the distal end portion of strut 24 and through grommets 98 so that it secures edge 94 of deck 90 to the distal end portion of strut 24. The end of lashing member 116 on strut 24 is releasably secured to a further jam cleat 120 mounted on the strut. Thus, by tightening lashing member 116, the flexible deck 90 can be placed under tension.

As best appreciated with reference to FIGS. 8 and 2, the forward attachment point or grommet 114 of deck 90 is positioned rearwardly and below juncture 30 of the frame. An elongated tension member 122 including a shortening device or turnbuckle 124 extends from juncture 30 to forward attachment point or grommet 114, tension member 122 being provided with a hook extending through this grommet. Tension member 122 can be shortened by means of turnbuckle 124 to thereby pull the deck 90 forwardly and upwardly, and thus put the deck under tension. Preferably, deck 90 is provided with reinforced portions 125 extending rearwardly and away from one another from the vicinity of the forward attachment point or grommet to the rear edge of the deck. Lashing member 116 also tends to pull the entire forward edge of deck 90, along the lengths of guides 100 and 102, forwardly, and upwardly, away from crossbeam 64. Although the deck may sag slightly beneath the upwardly extending plane of struts 24 and 26, the deck will not sag to the generally horizontal plane defined by the distal ends 32, 34 and 36 of the struts. Therefore, a sailor S positioned on the deck will always be maintained above the level of the water.

A rudder assembly 130 (FIGS. 2, 6, and 8) is releasably secured to crossbeam 64 adjacent the longitudinal centerline of the vessel. Rudder assembly 130 includes a platelike fin 132 which extends vertically when the rudder is in its operative position, fastened to the crossbeam. The rudder assembly also includes a platelike hydrofoil element 134 which extends transversely of fin 132 so that the hydrofoil element 134 lies in a generally horizontal plane when the rudder is in its operative position. As best seen in FIG. 8, hydrofoil element 134 has a positive angle of incidence $\alpha$. That is, the chord plane of hydrofoil element 134 slopes upwardly towards the front of the vessel. As used herein, the term "angle of incidence" refers to the angle between the hydrofoil element chord plane and the static or resting water line plane of the vessel.

A clamp 136 including a U-shaped first plate 138, flat second plate 140 and bolts 142 urging these plates together is secured to crossbeam 64 adjacent the longitudinal centerline of the vessel, and a bracket 144 is releasably secured to the clamp by removable pins 146 extending through the bracket and through plate 140 of the clamp. The vertical fin 132 of rudder assembly 130 in turn is mounted to bracket 144 for pivotal movement about a vertical axis by means of a pintle 148 extending through vertically aligned holes in the bracket 144. Desirably, the dimensions of clamp 136 are selected so that the clamp can pass through one of pockets 92 during assembly or disassembly of the vessel. Bracket 144 and hence rudder assembly 130 would be removed during any such assembly or disassembly. A tiller 150 is attached to the vertical fin 132 and projects forwardly, over the main portion of deck 90.

Figure 8:
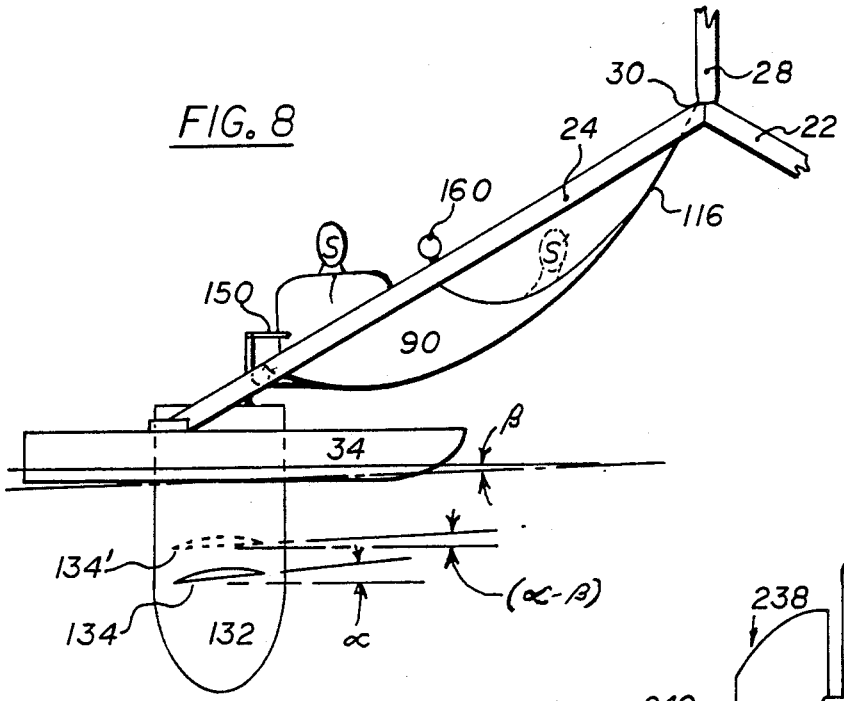
FIG. 8 is a schematic, fragmentary, elevational view showing the vessel of FIGS. 1–7.

As best appreciated with reference to FIG. 8, hydrofoil 134 exerts upward lift on the vessel, and particularly on crossbeam 64 as the vessel moves forwardly through the water. The vessel consequently tends to pitch upwardly at the rear through an angle $\beta$ so that hydrofoil portion 134 moves upwardly to the position indicated at 134' in FIG. 8. At this position, the angle of attack of the hydrofoil member (the angle between the chord plane of the hydrofoil member and the relative water flow vector) is reduced to $(\alpha-\beta)$. This reduced angle of attack tends to reduce the lift exerted by the hydrofoil, so that the vessel comes to a stable equilibrium position at any given forward speed.

Propulsion means are provided for moving the vessel along the water surface. These include clips 156 for securing a generally conventional sail assembly 152 and auxiliary mast 154 to the mast 28 of frame 20. A conventional boom 158 is also provided. If desired, a conventional spinnaker can be rigged from auxiliary mast 154 or from frame mast 28, and other sails may also be deployed. Means to pivotally secure cars (oarlocks) 160 are secured to aft struts 24 and 26 adjacent the forward edge of deck 90.

The dimensions of the vessel and the load carrying capacity of the pontoons may be varied as desired to provide vessels of varying passenger capacity. The construction according to this embodiment of the present invention is particularly advantageous in a vessel sized and adapted to accommodate three persons or less, and most preferably only a single sailor. Desirably, the trapezoidal main portion of deck 90 extends forwardly from crossbeam 64 by a distance X (FIG. 2) less than about 40% and more preferably less than about 33%, of the fore-to-aft distance between the crossbeam 64 and juncture 30. As will be appreciated with reference to FIG. 1, a sailor S can be accommodated in a normal, natural sailing position, seated on deck 90 adjacent one of the aft spars. Moreover, the sailor can board the vessel readily, using the crossbeam 64 and/or one of the struts 24 or 26 bordering the deck in much the same fashion as one would use a gunwale of a conventional boat. The difficulties inherent in attempting to board the edge of a flexible net are thus substantially eliminated. As also shown in FIG. 1, the sailor S can move to the rowing position indicated at S' in FIGS. 1 and 8. In this position, the sailor faces rearwardly, and the flexible deck 90 acts as a chair. The upwardly sloping forward portion of the deck 90 supports the sailor's buttocks and back (FIG. 8), whereas the sailor may rest his feet against crossbeam 64. He can then actuate oars 162 extending through oarlocks 160. As will be appreciated, this provides a natural, ergonomically desirable position for rowing the vessel. Indeed, the rowing qualities of the vessel are good enough that it is competitive with conventional high performance rowboats such as shells, sculls and the like. Moreover, the vessel according to this aspect of the present invention has stability far superior to the conventional high performance rowboats and hence is far better suited for use in moderate or rough seas.

Because the main portion of deck 90 extends forwardly from crossbeam 64 only by a limited distance (FIG. 2) the sailor's weight is necessarily concentrated in this limited region of the deck, and hence much of the sailor's weight is transmitted through the deck to crossbeam 64 and through the crossbeam to struts 24 and 26 immediately adjacent the junctures of those struts with pontoons 52 and 54. Other portions of the sailor's weight and like loads imposed by the sailor's body are transmitted directly through lashing member 116 to struts 24 and 26, but in each case these loads are transmitted to the distal end portions of the struts, adjacent the pontoons. The load imposed by the sailor's weight in this fashion do not apply appreciable bending or buckling stresses to struts 24 and 26. Although some of the sailor's weight is transmitted via tensioning member 122 to the frame at juncture 30, this portion is relatively low.

As noted above, the frame 20 desirably is arranged for disassembly and folding so that the vessel can be stored or transported conveniently. The deck and crossbeam are particularly well suited to use with such a folding structure. All that is required in disassembly is to release rope or lashing member 116 from cleat 120 on strut 24 and unwind the lashing member from this one strut and release tensioning member 122 either from the juncture 30 of the frame or from the forward attachment point 114 of deck 90. Also, the removable pins 84, 86 and 82 must be removed from yokes 66 and 68. After these steps have been accomplished, the crossbeam 64 can be swung inwardly towards port aft strut 26, with the deck still attached to the crossbeam and to the port aft strut. The deck can be wrapped around the port aft strut and around the cross beam, typically after rudder assembly 130 has been removed by releasing pins 146 (FIG. 6). In the stowed condition the deck and crossbeam add essentially nothing to the bulk of the vessel. The lift exerted by hydrofoil member 134 also tends to counteract any downward forces exerted by the sailor's body on the deck and crossbeam. Stated another way, loads transmitted downwardly to the hydrofoil member 134 are transmitted to the water without passing through struts 24 and 26. Moreover, the upward lift of the hydrofoil member is provided at the center of crossbeam 64. This tends to reinforce the crossbeam against downward bending under loads applied by the sailor's body. As will be appreciated, the upward lift of the hydrofoil member increases rapidly with increasing forward speed of the vessel. Because the loads applied by the sailor's body, such as inertial or acceleration loads upon traversing waves, swells or the like tend also to increase with the forward speed of the vessel, this hydrofoil action is particularly desirable. In conservative design of a boat for the average recreational sailor, the hydrofoil forces typically are disregarded, and the crossbeam 64 is made strong enough to withstand the design loads without benefit of the counteracting hydrofoil forces. In "all out" racing design, the crossbeam may be lightened in view of the expected hydrofoil forces.

The deck, rear crossbeam and associated elements are very light themselves. Moreover, because of the favorable distribution of loads engendered by the deck and crossbeam assembly, the remaining elements of the frame can also be extremely light. A vessel capable of carrying a 200 lb. sailor with resonable factors of safety regarding buoyancy and structural strength, constructed according to the embodiment described above, may have a total weight of about 87 lbs., exclusive of sails, if the struts and crossbeam are formed from conventional aluminum tubing, whereas the weight may be reduced to about 40 lbs. if the struts, crossbeam and mast are formed from a composite Kevlar TM fiber and epoxy composite. Of this, the weight of the entire frame, crossbeam and deck assembly is only about 20 lbs., the remainder being hulls and rudder. By comparison, the weight of a typical sailing surfboard may be about 120 lbs., whereas typical conventional monohull sailboats with similar passenger capacity weigh about 450 lbs. The vessel according to this aspect of the present invention, however, can carry far more sail area without heeling over, because of the extraordinary beam provided by the tetrahedron space frame. Therefore, the vessel according to the present invention can go faster in the same wind. Moreover, the vessel according to the invention can tolerate higher winds and rougher seas than either a monohull sailboat or a sailing surfboard while still providing an acceptable ride and acceptable safety for the sailor.

The structure can be varied somewhat from that illustrated. The aft pontoons can be rigidly mounted to the remainder of the structure. In such an arrangement, the aft struts 24 and 26 may project rearwardly of the crossbeam, and the crossbeam may project laterally outwardly beyond the aft struts. The aft pontoons may be connected by a bracket or clevis to the tips of the aft struts, and a bracket may project forwardly and downwardly from each end of the crossbeam to the associated aft pontoon. Thus, these brackets will be connected to the aft pontoons forwardly of the tips of the aft struts, and the aft pontoons will be fixed against pivoting motion.

In other embodiments, the aft pontoons may be pivotable about vertical axes, and may be provided with individual rudders. Both aft pontoons in this arrangement can be connected to a common tiller for steering, and hence the center rudder can be omitted. Also, hydrofoils other than that illustrated can be connected directly to the pontoons or the crossbeam. Further, a bracket for supporting an outboard motor can be attached to the forward pontoon for high speeds.

Figure 9:
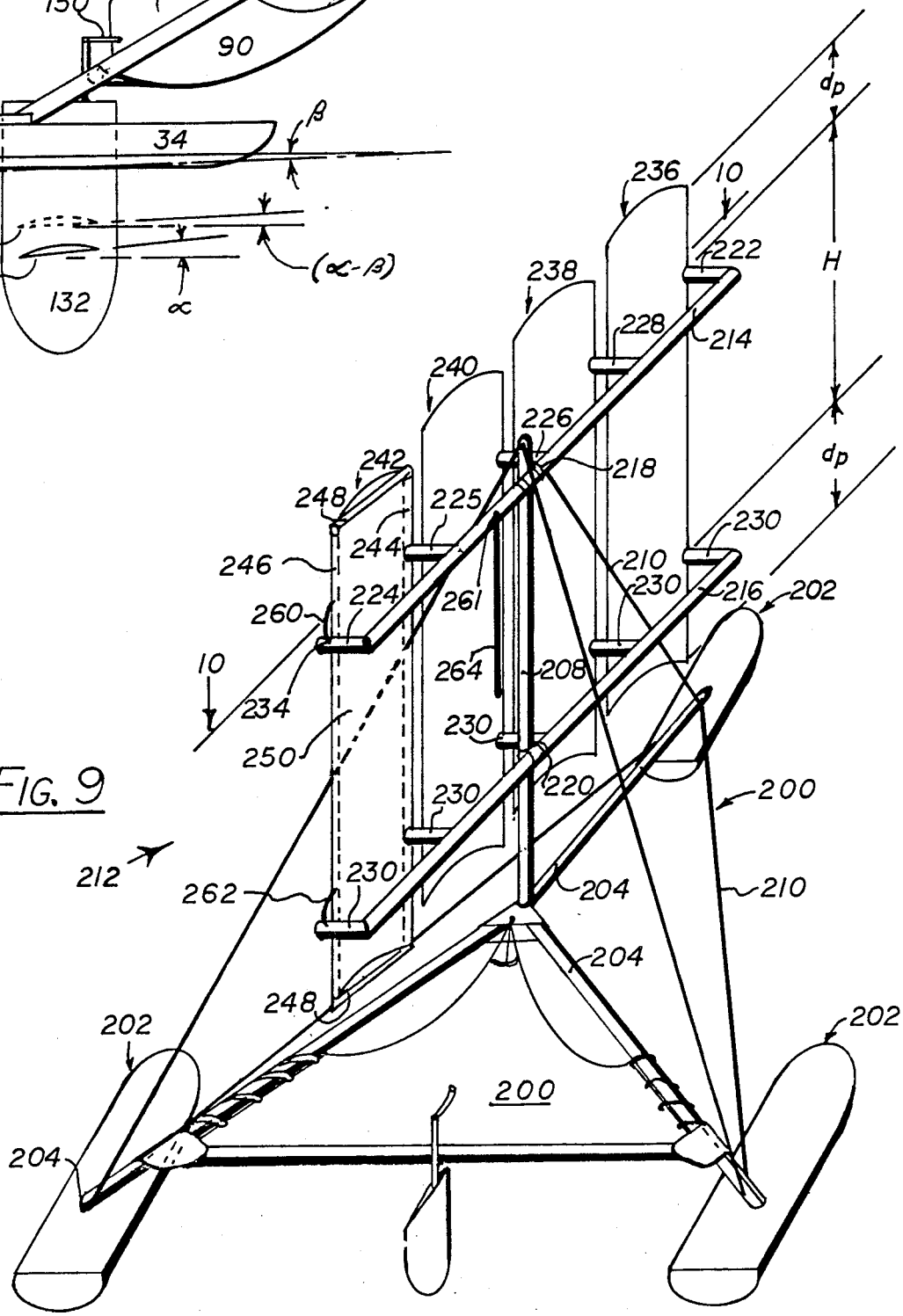
FIG. 9 is a schematic perspective view of a sail assembly according to a further embodiment of the present invention.
Figure 10:
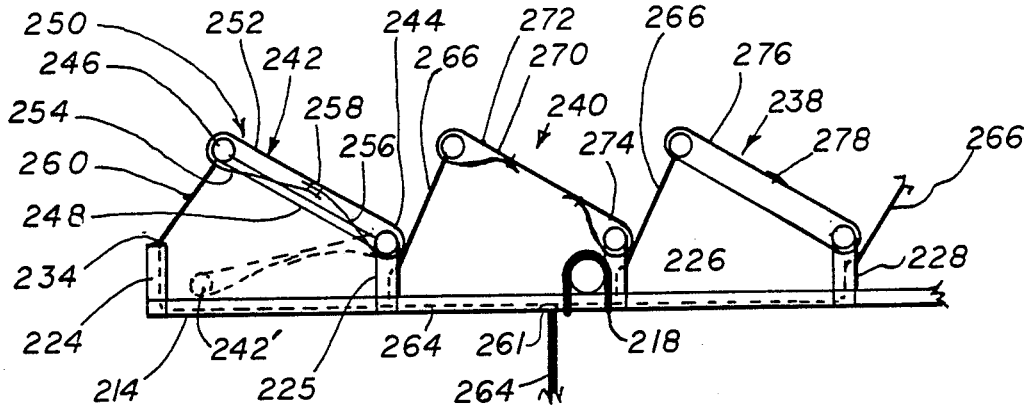
FIG. 10 is a top view of the sail assembly shown in FIG. 9.

A sailing vessel according to a further embodiment of the present invention, as shown in FIGS. 9 and 10 includes a tetrahedral space frame hull assembly 200 including pontoons 202, spars 204, deck 206, mast 208 and tensioning stay cables 210 generally similar to those described above. The vessel also includes a sail assembly 212. Sail assembly 212 includes an elongated upper spar 214 and a similar lower spar 216. Spars 214 and 216 are provided with securement clamps 218 and 220, respectively, for detachably securing them to the mast 208. Clamps 218 and 220 are arranged to secure the spars to the mast so that the spars extend substantially horizontally, and parallel to one another, along the fore and aft axis of the vessel, with upper spar 214 being disposed at a predetermined distance H above the lower bar 216. Upper spar 214 has a forward mounting lug 22 extending generally horizontally, and generally perpendicular to the spar at the forward end of the spar, a rearmost mounting lug 224 and three intermediate mounting lugs 225, 226 and 228. Lugs 224, 225, 226 and 228 extend parallel to lug 222 at spaced apart locations along the length of spar 214, these locations being selected so that the spacings between adjacent lugs are equal to one another. Lower spar 216 is provided with similar lugs 230, all of which extend parallel to one another and parallel to the mounting lugs of upper spar 214. The spacings between lugs 230 on the lower spar are equal to the spacings between the lugs on the upper spar, and each lug 230 on the lower spar is aligned with one of the lugs on the upper spar. Spars 214 and 216, and the associated lugs, are all hollow, tubular members. Each of lugs 224, 225, 226 and 228 have holes 234 adjacent their respective distal ends, remote from spar 214. Lugs 230 have similar holes.

The sail assembly 212 also includes four elongated blades or air foils, viz., a forwardmost blade 236, intermediate blades 238 and 240 and aft blade 242. Aft blade 242 includes a blade frame comprising a forward edge bar 244, an aft edge bar 246 and a pair of chordal bars 248 extending forwardly from aft edge bar 246. The aft edge bar 246 and forward edge bar 244 extend lengthwise along the length of the blade, and the chordal bars 248 extend perpendicular to the edge bars at the ends of the blade. Chordal bars 248 are fixedly mounted to aft edge bar 246 but are mounted to forward edge bar 244 for pivoting movement about the long axis of the forward edge bar. A flexible, sheetlike cover or sail element 250 is wrapped around forward edge bar 244 and aft edge bar 246 so that a continuous portion 252 extends along one side of the plane defined by bars 244 and 246, whereas two opposed end portions 254 and 256 extend on the opposite side of such plane. The opposed end portions 254 and 256 overlap one another and are fastened both to one another and to continuous portion 252 by a line of stitching 258 extending longitudinally, parallel to bars 244 and 246, along the length of the blade.

The forward bar edge 244 of aft blade 242 is fastened to intermediate lug 225 of top spar 214 and to the corresponding intermediate lug 230 of lower spar 216. The aft bar 246 of aft blade 242 is fastened to a line 260. Line 260 extends into the hole 234 in the aft lug 224 of upper spar 214. A similar line 262 extends from aft bar 246 of aft blade 242 to the aftmost lug 230 of lower spar 216. Line 260 extends into upper spar 214 through lug 224, and extends forwardly through the upper spar to a hole 261 in the upper spar adjacent mounting 218. Line 262 likewise extends through the lower spar 216 to a similar hole in the lower spar. As best seen in FIG. 10, the aft bar 246, chordal bars 248 and sail element 250 of aft blade 242 can swing or pivot relative to upper spar 214 (and relative to lower spar 216) between the position illustrated in solid lines and the position illustrated in broken lines at 242'. This pivoting action is analogous to the action of an ordinary sail in "coming about" to align the blade or sail with the relative wind as required. The exact position of the blade is controlled by lines 260 and 262. The ends of lines 260 and 262 remote from blade 242 are joined to a common control line 264 which in turn can be controlled by the sailor to control the position of the blade.

Each of the other blades 240, 238 and 236 are generally similar in construction to blade 242, and include generally similar sail elements, aft bars, forward bars and chordal bars. The forward bar of sail 240 is mounted to intermediate lug 226 on upper spar 214, and to the corresponding lug 230 on the lower spar, whereas the forward bar of intermediate blade 238 is mounted to lug 228 and the corresponding, aligned lug on the lower spar and the forward bar of forwardmost blade 236 is mounted to the forwardmost lug 222 on upper spar 214 and to the corresponding, forwardmost lug on the lower spar. Thus, the blades are arranged in a fore to aft array, with the forward edge of each blade (except for forwardmost blade 236) being disposed adjacent the aft edge of the next adjacent blade. In each case, the chordal bars, aft bar and sail elements of each blade are mounted for pivoting movement relative to spars 214 and 216 about a vertical axis adjacent the forward edge of the blade, viz, about the forward bar of the blade itself. As will be appreciated, the forward bars of the blades maintain the spars 214 and 216 in position relative to one another. Lines 266 (FIG. 10) extending from the aft bar of each of the blades 240, 238 and 236 pass through the associated lugs and spars to hole 261 adjacent, where they join common control line 264. Thus, by adjusting common control line 264, the sailor can position all of the blades simultaneously for optimum engagement with the wind. In the embodiment illustrated, the individual blades include different configurations of the flexible sheetlike or sail element. Thus, in intermediate blade 240, the sail element includes a single continuous sheet 270, a fold 272 extending around the forward of the blade and a further fold 274 extending around the aft bar, these folds being spaced apart from one another and secured by separate lines of stitching. Blade 238 has a sail element 276 extending in a single, continuous loop around both the forward and aft bars of the blade, this single continuous loop being secured by a single, continuous zone of stitching 278 extending lengthwise along the blade. As will be appreciated, the most typical constructions of sail assemblies according to this aspect of the invention utilize uniform constructions for the different blades in a single assembly. However, the assembly can be made with different constructions for each blade as shown.

In use, the sail elements or flexible elements of each blade are formed into an air foil shape by the forces exerted by the wind on the blade. The wind passing across these air foils creates forces which tend to pull the blade, and hence the vessel, forwardly through the water. As will also be appreciated, there are significant forces on the bars of the individual blades transverse to the lengthwise direction of the blades. That is, each bar behaves as a complex beam, stressed in bending. The locations of the upper spar 214 and lower spar 216 along the lengths of the blades are carefully selected and optimized to minimize the bending stress in the elements of each blade. Each blade is longer than the predetermined distance H between the spars, and each blade protrudes by a predetermined protrusion distance $D_p$ above upper spar 214 and below lower spar 216. According to this aspect of the present invention, it has now been found that, in an arrangement including only two spars such as spars 214 and 216 shown in FIG. 9, the bending stresses in the individual blades can be minimized if $d_p$ equals 20.69% of the length of the individual blade. It is most desirable to maintain this exact figure, but acceptable results generally can be obtained where $d_p$ equals between about 15% and about 25%, or more preferably between about 20% and about 21.4% of the blade length. Stated another way, where the distance $d_p$ is maintained as close as possible to the optimum 20.69% of blade length, the structure of each blade can be made as light as possible while still maintaining acceptable bending strength to survive relatively high wind loadings. Because of this, the entire sail assembly can have lower weight than as a single conventional sail of approximately the same area. A sail assembly according to this aspect of the invention, however, will have substantially better performance pointing high on the wind than a single conventional sail because the assembly according to this aspect of the present invention has substantially greater leading edge length and effectively acts as a sail having aspect ratio (length to chord ratio) equal to the aspect ratio of each individual blade.

Figure 11:
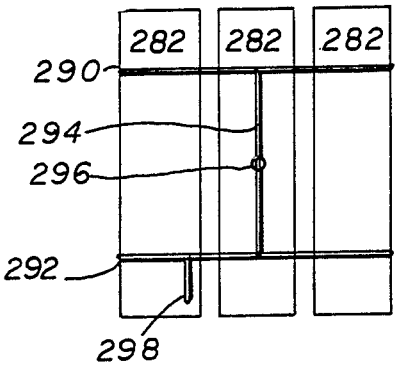
FIGS. 11 and 12 are a schematic elevational views of a sail assembly according to a further embodiment of the present invention.

The sail assembly according to a further embodiment of the present invention, schematically shown in FIG. 11, includes only three blades 282. Each blade is pivotally mounted to upper and lower spars 290 and 292. However, in this arrangement the forward tubes or beams of the individual blades 282 are not rigidly mounted to the spars or to lugs extending therefrom, so that the entire blade 282 can swing as a unit relative to spars 290 and 292. Because the tubes of the blades do not serve to maintain the spars at predetermined spacings from one another, a separate spacing bar 294 is provided. The entire sail assembly is connected to the vessel via a single mounting 296 on spacing bar 294. Spacing bar 294 adds some weight to the assembly, and hence use of such a spacing bar is somewhat less preferred. As also shown in FIG. 11, lower spar 292 is provided with a handle 298 so that the sailor can manually control the position of the entire sail assembly in pivoting motion around mounting 296. Because the forces on the sail assembly perpendicular to the plane of spars 290 and 292 are substantially uniform and balanced around mounting 296, the sailor can exert good control over a sail assembly of substantial area by forces manually applied to a handle such as handle 298.

Figure 12:
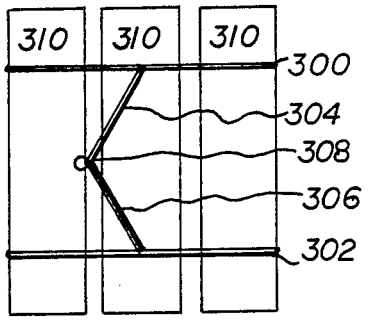

A further sail assembly according to the present invention as shown in FIG. 12, is generally similar to those of FIGS. 9–11. However, the upper spar 300 and lower spar 302 are interconnected by a pair of arms 304 and 306 projecting away from the plane of the blades to a single pivot mounting 308. As with the arrangement of FIG. 11, the entire sail assembly is mounted at this single mounting 308 to the boat structure. In the embodiment of FIG. 12, the forward tubes or bars of the individual blades 310 serve to maintain the spars 300 and 302 in the desired spaced-apart relation. A handle (not shown) similar to that shown in FIG. 11 may be provided for this embodiment as well.

Figure 13:
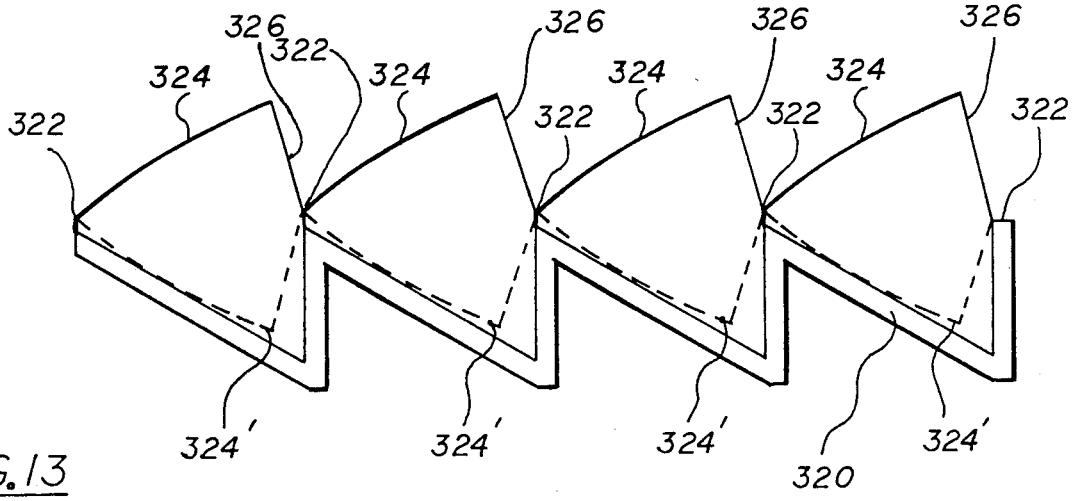
FIG. 13 is a schematic top view of a sail assembly according to yet another embodiment of the invention.

As shown in FIG. 13, each spar may be fabricated in a zigzag configuration rather than with the projecting lugs illustrated in FIGS. 9 and 10. Thus, the zigzag spar 320 provides mounting points in one plane for attaching all of the forward edges of the individual blades 324 while still permitting pivotal movement of the aft edges of individual blades to the alternate position shown in broken lines at 324'. The lines for controlling the individual blades 326 preferably extend to the peaks 322 of the zigzag spar 320 and extend through the spar as described above with reference to FIGS. 9 and 10.

Figure 14:
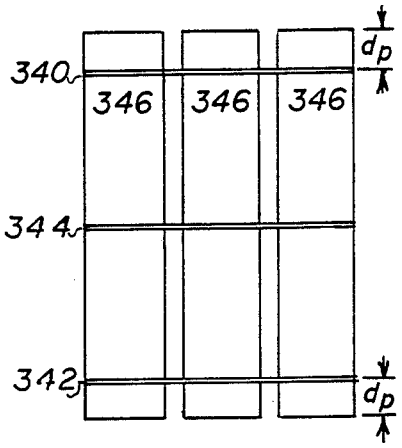
FIG. 14 is a schematic elevational view of a sail assembly according to a still further aspect of the invention.

Yet another embodiment of a sail assembly according to the present invention is shown in FIG. 14. This assembly includes an uppermost spar 340, lowermost spar 342 and a middle spar 344 equidistant from the uppermost and lowermost spars and parallel thereto. In this three-spar arrangement, the construction is generally similar to those described above for a two-spar arrangement. However, the optimum protrusion distance $d_p$ is different for a three-spar embodiment. Thus, in a three-spar arrangement, each blade 346 should protrude upwardly above uppermost spar 340 and downwardly below lowermost spar 342 by a protrusion distance which is as close as possible to 9.48% of the length of the blade. Although acceptable results can be achieved with protrusion distances between about 5% and about 15% of the individual blade length in a three-spar embodiment, the protrusion distance should be as close as possible to the aforementioned 9.48% optimum figure, viz, preferably between about 9% and about 10% of the blade length. It is also most desirable to have the intermediate spar or middle spar 344 exactly equidistant between the uppermost and lowermost spars 340 and 342. In general, the three-spar arrangement is less preferred, vis a vis, the two-spar arrangement discussed above, inasmuch as the added spar increases drag somewhat and also adds some weight to the total assembly. However, even with this arrangement overall, performance superior to that of conventional sails can be achieved.

A vessel according to a still further embodiment of the present invention as shown in FIGS. 15–19 includes a tetrahedral space frame hull structure 400 generally similar to those described above. The vessel also includes a sail assembly 412 generally similar to that described above with reference to FIGS. 9 and 10. However, in sail assembly 412 upper spar 414 and lower spar 416 are pivotally mounted to a common bar 417 so that upper spar 414 is pivotable about an upper spar pivot axis 419, whereas lower spar 416 is pivotable about a lower spar pivot axis 421. Axes 419 and 421 are substantially parallel to one another. Attachments 423 are provided for releasably attaching common member 417 to to the mast of the vessel, so that spar pivot axes 419 and 421 extend generally horizontally and generally beamwise, transverse to the fore and aft direction of the vessel, and so that the spar pivot axes are spaced vertically from one another, with upper spar pivot axis 419 being above lower spar pivot axis 421. Each of spars 414 and 416 has four lugs 425 projecting transversely to the direction of elongation of the spar, so that the lugs project substantially parallel to spar pivot axis 419 and 421. Each lug 425 includes an inboard portion 427 fixedly connected to the remainder of the spar and an outboard portion 429 pivotably mounted to the inboard portion 427 so that the outboard portion of each lug can pivot with respect to the inboard portion about an articulation axis 431 substantially parallel to spar pivot axes 419 and 421. The tips of the outboard portions 429 of the lugs 425 remote from the main elements of the spars 414 and 416 define a common plane 433 (FIGS. 17 and 19) normal to spar pivot axes 419 and 421, common plane 433 being offset from the main elements of spars 414 and 416 in a lateral direction parallel to spar pivot axes 419 and 427.

A plurality of individual blades 435, each having a leading or forward edge 437 and a trailing or aft edge 438 are provided. Blades 435 are composite, Kevlar T-M /epoxy airfoils. The forward edge 437 of each blade is pivotally mounted to one lug 425 on upper spar 414 and to one lug 425 on lower spar 416, so that each blade is pivotable with respect to the associated lugs, and hence with respect to the spars 414 and 416, about a blade pivot axis 439. The blade pivot axes 439 are transverse to the spar pivot axes 414 and 421, and, when the sail assembly is mounted to the vessel as shown, the blade pivot axes 439 extend generally vertically, whereas the spars extend generally fore and aft. Also, the blade pivot axes are disposed substantially in the common plane 433 defined by the tips of the lugs 425. Each blade 435 is provided with upper and lower links 441 and 443, respectively. The links 441 and 443 are flexible but substantially inextensible, and may be constituted of rope or cable. Each upper link has an inboard end 453 connected to the tip of one lug 425 on upper spar 414 and an outboard end 455 connected to the associated blade 435 adjacent its trailing edge 438. The upper link 441 of each blade 435 is connected to a lug 425 aft of the pivot axis 439 of that blade. Thus, each upper link 441 is connected between a point on blade 435 remote from the pivot axis and a point on upper spar 414 remote from the pivot axis 439 of the blade but lying in common plane 433. Each lower link 443 is likewise connected between a point on the associated blade 435 remote from pivot axis 439 and the tip of a lug 425 aft of the pivot axis 439 of the blade.

Figure 18:
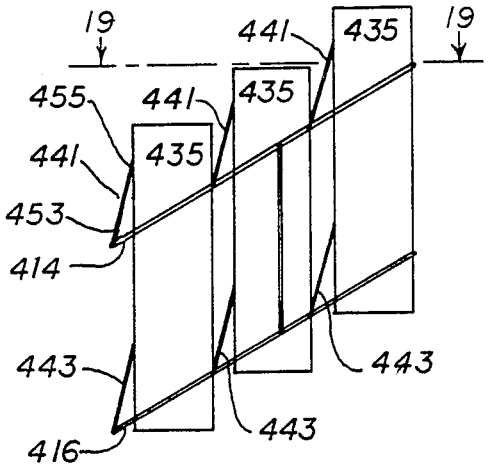
FIG. 18 is a view similar to FIG. 16 but showing the sail assembly in a different operative position.
Figure 16:
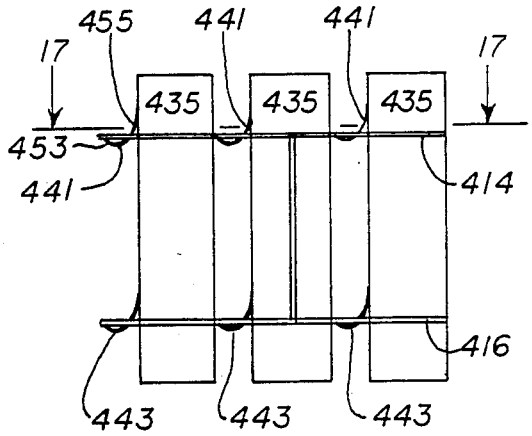
FIG. 16 is a schematic elevational view of the sail assembly shown in FIG. 15.
Figure 17:
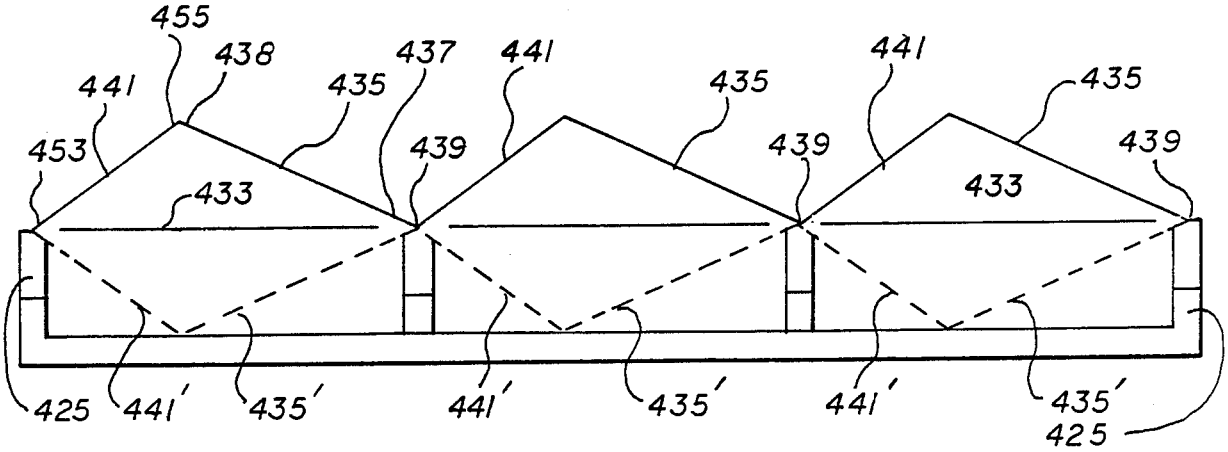
FIG. 17 is a schematic view along line 17—17 in FIG. 16.
Figure 19:
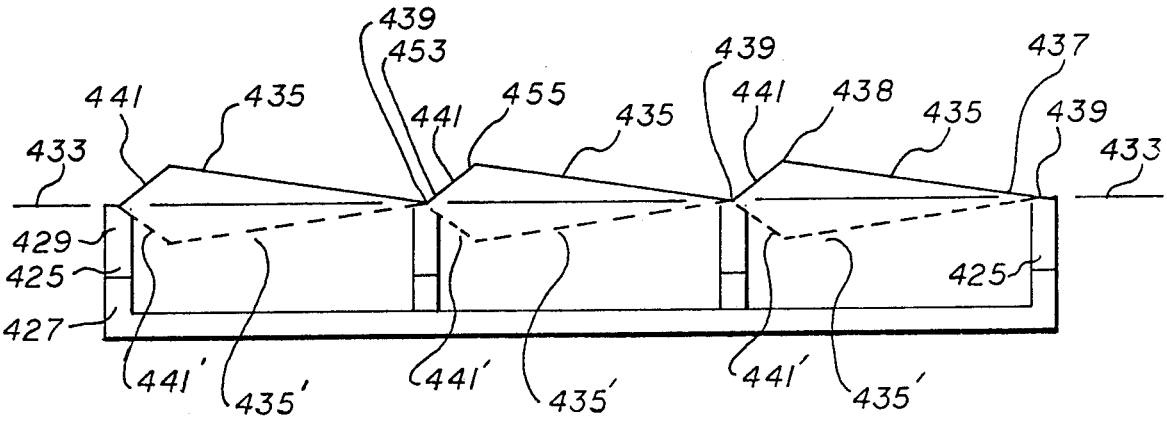
FIG. 19 is a schematic view taken along lines 19—19 in FIG. 18.

As best appreciated with reference to FIGS. 16–19, each blade 435 is pivotable about its blade pivot axis 439 between positions on either side of common plane 433. Links 441 and 443 limit the extent of this pivoting motion. In the position shown in FIGS. 15, 16 and 17, with the links 414 and 416 disposed in a generally horizontal position, each upper link 441 is disposed in a generally horizontal plane, so that blades 435 can swing through a substantial angle between the positions illustrated in solid lines in FIG. 17 and the positions illustrated at 435' in the same figure. However the sailor can deliberately move spars 414 and 416 to the tilted position illustrated in FIGS. 18 and 19, where the spars are inclined downwardly towards their rear or aft ends. A handle 451 (FIG. 15) may be provided for facilitating control of this pivoting motion by the sailor. In movement from the horizontal position illustrated in FIGS. 15–17 to the position illustrated in FIGS. 18 and 19, the pivotal connections at lugs 425 act as the joints of a parallelogram linkage so that the blades and spars pivot with respect to one another about their respective articulation axes 431. Thus, the pivot axes 439 of the blades remain substantially vertical. The inboard end 453 of each upper link 441 moves downwardly with respect to the outboard end 455 of the same link. As seen in FIG. 18, each upper link 441 extends substantially upwardly and downwardly when the spars are in this tilted position. Likewise, each lower link 443 also extends substantially upwardly and downwardly. In this position, the range of motion of the outboard end 455 of each upper link with respect to the inboard end 453 in the horizontal directions transverse to common plane 433 is substantially diminished. Stated another way, because each upper link 441 is displaced out of the horizontal plane occupied by that link in the untilted position shown in FIGS. 15–17, each upper link 441 is effectively foreshortened even though the length of the link itself does not change. Thus, the range of pivoting motion of each blade 435 about its pivot axis 439 is substantially reduced. With the spars in this tilted position, each blade can swing only between the position illustrated in solid lines in FIG. 19 and the position shown in broken lines at 435" in the same figure. The lower links 443 act in substantially the same way.

Figure 15:
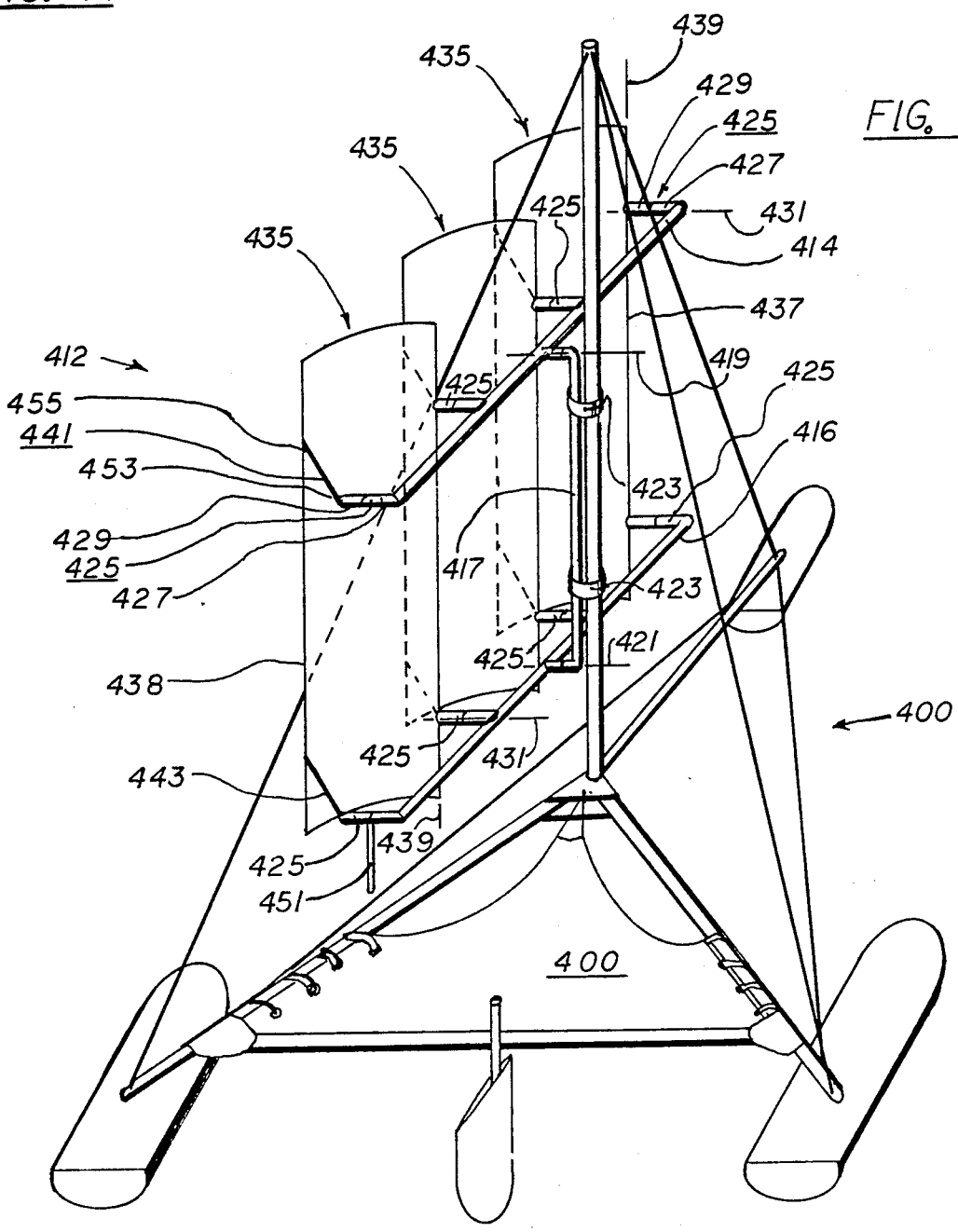
FIG. 15 is a perspective view of a vessel and sail assembly according to a further aspect of the invention.

By controlling the pivoting motion of the spars 414 and 416 about spar pivot axes 419 and 421, the sailor can control the angles of blades 435 with respect to the fore and aft axis of the vessel, and hence can set the blades to the appropriate angle for various wind conditions. As will be appreciated, this arrangement offers a particularly simple mechanism for setting the angles of the blades. Although this arrangement can be utilized on a sailing vessel of any size, it offers particularly desirable benefits when applied to a relatively light sporting sailboat, and most particularly when applied to a tetrahedral space frame vessel as described above. Thus, as seen in FIG. 15, a single sailor seated on the deck may have complete control of the vessel. This control is achieved without complex arrangements of lines and rigging. Moreover, because the spars need not pivot about the vertical axis (the axis of the mast), the stays extending from the mast do not interfere with operation of the sail assembly.

Yet another benefit afforded by this arrangement is the ability to collapse the entire sail assembly. If links 441 and 443 are detached from either the spars or the blades, the tilting movement of the spars with respect to common member 417 can be continued beyond the tilted position shown in FIG. 18 to a storage position in which the spars extend almost parallel to common member 417. In this storage position, the blades overlap one another. The width of the entire sail assembly, in the direction transverse to the blades, is just slightly more than the width of one blade. Therefore, the sail assembly can be readily handled and transported, and can be placed back in condition for operation by making a few simple connections between the links and the spars.

As will be appreciated, the features of the various sail assemblies can be combined with one another. Thus, the pivoting actions of the sail assembly described with reference to FIGS. 15–19 can be accommodated in a sail assembly having spars of zigzag configuration as shown in FIG. 13 or in a sail assembly with three or more spars (FIG. 14). Also, a sail assembly with control lines as described above with reference to FIGS. 9 and 10 can be provided with articulation points as described with reference to FIGS. 15–19 and hence can be made to collapse for storage. If desired, the mast of the vessel itself may serve in place of the common member 417 (FIG. 15). In this case, each of the spars would be pivotally mounted to the mast for movement about the horizontal spar pivot axes as described above.

Numerous variations and combinations of the features described above can be employed. Thus, the sail assemblies described above can be employed on conventional monohull, catamaran or trimaran hulls as well as on the space frame hulls described above. Also, each of the blades in the multiblade sail assembly as discussed above can be provided with appropriate means for limiting lengthwise air flow along the blade, i.e., curved or cupped ends or auxiliary air foils along the end of the blade. Further, where the entire sail assembly, including the spars, can pivot relative to the vessel, the individual blades need to be pivotable with respect to the spars. The number of blades can be varied somewhat. Although greater numbers of blades in an individual sail assembly theoretically provide even better performance, the theoretical advantages of more numerous blades are offset to some degree by the disadvantages of a more complex assembly and slightly greater costs as the number of blades increases. Two or five blade assemblies typically provide a good balance of these factors in light, sporting sailboats. The sail assemblies preferably are arranged for convenient colapsing. The flexible materials utilized for the sail elements or coverings of the individual blades can be substantially any flexible material having sufficient strength and preferably, relatively lightweight. Thus, conventional sail making materials such as nylon fabric and the like are preferred, although plastic sheeting, canvas and the like may also be employed. Moreover, solid blades with preformed airfoil shapes can also be used. Preferably, solid blades are fabricated from extremely low density materials such as plastic foams or the like with appropriate reinforcements where necessary. The low bending stresses achieved by assemblies according to preferred aspects of the present invention greatly facilitate the use of such materials in sail construction.

The tubular structural elements utilized in various aspects of the present invention, such as the fore and aft bars of the individual sail blades, the spars, lugs and the like of the sail assembly, and the struts and masts of the tetrahedral space frames described above should preferably be fabricated from relatively lightweight structural materials. Aluminum or magnesium alloy tubing can be employed. However, for maximum performance composite tubing fabricated from rigid non-metallic fibers such as aramid plastic sold under the registered trademark Kevlar or carbon fibers with epoxy resin is even more preferred. Although conventional round tubing of uniform cross section at all points along a given structural element can be employed, various expedients can be employed to improve the strength to weight ratio of a given member. Thus, the member may be fabricated with an oval or other non-round cross section having anisotropic structural properties, and the direction of greatest strength may be aligned with the direction of greatest expected stress.

As these and other variations and combinations can be utilized, the foregoing description of the preferred embodiments should be taken by way of illustration rather than by way of limitation of the present invention as defined in the claims.

What is claimed is:

1. A waterborne vessel comprising:

(a) a frame including two elongated aft struts, an elongated forward strut and an elongated mast, each of said struts and said mast having a juncture end, a distal end, and a distal end region ajacent the distal end, a connecting means for attaching said juncture ends to one another to form a common juncture so that said struts project outwardly and downwardly from said juncture, said mast projects upwardly from said juncture and the distal ends of said struts and said mast define the verticies of a tetrahedron, said frame also including substantially flexible but substantially inextensible stay means for connecting the distal end region of said mast to the distal end regions of each of said struts and for connecting the distal end region of said forward strut to the distal end regions of each of said aft struts, wherein said stay means are the only structural elements connecting said distal end region of said forward strut with said distal end region of said aft strut;

(b) A forward pontoon and two aft pontoons, and pontoon connecting means for connecting said forward and aft pontoons to the distal end regions of said forward and aft struts, respectively;

(c) an elongated, substantially rigid crossbeam having opposite ends and end regions adjacent thereto;

(d) crossbeam connecting means for connecting said end regions of said crossbeam to said distal end of said aft struts; and (e) propulsion means for propelling the vessel along the water.

2. A vessel as claimed in claim 1 further comprising a deck and deck connecting means for connecting said deck to said crossbeam.

3. A vessel as claimed in claim 1 wherein said deck includes a forward attachment point disposed forwardly of said crossbeam and said deck connecting means includes forward attachment means for connecting said forward attachment point of said deck to a portion of said frame adjacent said juncture.

4. A vessel as claimed in claim 3 wherein said forward attachment point is disposed rearwardly of and below said juncture, and said forward attachment means includes means for pulling said forward attachment point of said deck upwardly and forwardly towards said juncture.

5. A vessel as claimed in claim 4 wherein said deck is flexible and sheetlike, said deck has an elongated rear edge, said deck connecting means includes means for connecting said rear edge of said deck to said crossbeam so that said rear edge extends along said crossbeam.

6. A vessel as claimed in claim 5 wherein said deck includes a pair of opposed lateral edges, further comprising lateral attachment means for securing each of said lateral edges of said deck to one of said aft struts so that said lateral edges extend along said aft struts for a predetermined distance forwardly from said crossbeam.

7. A vessel as claimed in claim 6 wherein said deck has openings spaced along each of said lateral edges, said lateral attachment means including a flexible lashing element having two end portions, each such end portion being laced around one of said aft struts and through the openings in the associated lateral edge of said deck.

8. A vessel as claimed in claim 7 wherein said deck includes a pair of tubular guides extending inwardly and forwardly from the forward ends of said lateral edges, an intermediate portion of said lashing element between said end portions extending through said tubular guides, said intermediate portion being connected to said frame adjacent said juncture.

9. A vessel as claimed in claim 8 wherein said tubular guides are curvilinear and concave in the direction away from said rear edge.

10. A vessel as claimed in claim 9 wherein said deck includes a main portion bounded on three sides by said lateral edges and said rear edge, said deck also including a projecting portion extending forwardly from said main portion on the forward side of said main portion, said tubular guides bounding said projecting portion.

11. A vessel as claimed in claim 10 wherein said main portion of said deck is generally trapezoidal, said lateral edges sloping towards one another in the forward direction, away from said rear edge.

12. A vessel as claimed in claim 11 wherein said main portion extends forwardly from said rear edge less than about 40 percent of the fore-to-aft distance between said crossbeam and said juncture.

13. A vessel as claimed in claim 4 wherein said pontoon connecting means is operative to connect said aft pontoons to said aft struts for pivoting motion about beamwise axes parallel to said crossbeam, said crossbeam connecting means being operative to connect the end regions of said crossbeam to the distal end regions of said aft struts.

14. A vessel as claimed in claim 5 wherein said sheetlike flexible deck includes an elongated pocket extending along said rear edge, said crossbeam being received in said pocket when said deck is secured to said frame.

15. A vessel as claimed in claim 1 wherein said propulsion means includes a sail and means for connecting said sail to said frame.

16. A vessel as claimed in claim 1 wherein said propulsion means includes means for pivotally securing oars to said aft struts.

17. A vessel as claimed in claim 1 wherein said propulsion means includes means for securing an outboard motor to said crossbeam.

18. A vessel as claimed in claim 1 further comprising a rudder and rudder attachment means for securing said rudder to said aft crossbeam between said ends thereof, so that said rudder is pivotable about a generally vertical axis with respect to said aft crossbeam.

19. A vessel as claimed in claim 18 wherein said aft crossbeam is substantially tubular and said rudder connecting means includes a pair of opposed gripper elements disposed on opposite sides of said tubular crossbeam, means for urging said gripper elements towards one another so that said gripper elements bear on and engage the tubular crossbeam, and means for connecting said rudder to at least one of said gripper elements.

20. A vessel as claimed in claim 18 wherein said rudder includes a fin element and a hydrofoil element extending transverse to said fin element, said fin element projecting downwardly from said aft crossbeam when said rudder is secured to said crossbeam, said hydrofoil element extending generally horizontally when said rudder is secured to said crossbeam.

21. A vessel as claimed in claim 1, further comprising a hydrofoil and means for connecting said hydrofoil to said crossbeam.

22. A vessel as claimed in claim 1 wherein said connections made by said stay means, said connecting means of said frame and said crossbeam connecting means are releasable, whereby said vessel may be disassembled or folded.

23. A vessel as claimed in claim 22 wherein said crossbeam connecting means includes a pair of yokes, one of said yokes extending around the distal end region of each of said aft struts, each of said yokes defining a slot adapted to receive one end of said aft crossbeam, said crossbeam connecting means also including at least one pin extending through each of said yokes and through the associated end of the aft crossbeam.

24. A vessel as claimed in claim 23 wherein said pins of said crossbeam connecting means include one hinge pin extending through one of said yokes and through the associated end of the aft crossbeam, all of the other ones of said pins of said crossbeam connecting means being removable, whereby said aft crossbeam can be pivoted about said hinge pin to lie against one of said aft struts when said other ones of said pins are removed.

25. A sail assembly for a sailing vessel comprising:

(a) two or more elongated spars;

(b) spar securement means for securing said spars to a sailing vessel so that each said spar is pivotable about a generally horizontal spar pivot axis, said spar pivot axes being generally parallel to one another and spaced apart from one another in the vertical direction;

(c) a plurality of elongated blades each having a leading edge and a trailing edge;

(d) blade attachment means for connecting each said blade to each of said spars so that each said blade is pivotable with respect to each spar about a blade pivot axis generally parallel to the leading edge of the blade and so that each said blade is also pivotable with respect to each said spar about an articulation axis substantially parallel to said spar pivot axes; and (e) at least one link attached to each of said blades remote from the blade pivot axis of the blade, each said link being connected to one of said spars remote from the pivot axis of the associated blade, said links limiting the pivoting movement of said blades about said blade pivot axes, whereby pivoting movement of said spars about said spar pivot axes will alter the limits of pivoting movement of said blades about said blade pivot axis.

26. A sail assembly as claimed in claim 25, wherein said spars define a common plane normal to said spars pivot axes, said blade pivot axes extending in said common plane, the trialing edge of each said blade being pivotable to either side of said common plane.

27. A sail assembly as claimed in claim 26 wherein each said link is attached to one of said spars at an attachment point substantially in said common plane.

28. A sail assembly as claimed in claim 27 wherein each said link is flexible but substantially inextensible.

29. A readily colapsible sail assembly for a sailing vessel comprising:

(a) a plurality of elongated substantially rigid members;

(b) a plurality of elongated blades each blade having a leading edge and a trailing edge extending lengthwise along the blade; and (c) blade attachment means for connecting each of said blades to each of said members so that said blades are parallel to each other, and so that said members are parallel to each other, and so that said blades are rotateable relative to said members between the position wherein said blades are perpendicular to said members, and the positions wherein said blades are substantially parallel to said members, and so that said blades project beyond said members by predetermined protrusion distances; and (d) member securement means for securing said members to a sailing vessel; and (e) a means for limiting the distance which said trailing edge of each of said blades can travel from the surface which is defined by said leading edges of said blades; and whereby in the position wherein said blades are substantially parallel to said members, said assembly is collapsed and, whereby in the position wherein said blades are substantially perpendicular to said members, said assembly is opperative to extract force from the wind.

30. A sail assembly as claimed in claim 29, further comprising a means for articulating said members relative to said blades between the position wherein said members are substantially perpendicular to said blades and wherein said blades are opperative to produce force from the wind, to the position wherein said members are substantially parallel to said blades and wherein said assembly is colapsed.

31. A sail assembly as claimed in claim 29 further comprising at least one link attached to each of said blades remote from the pivot axis of said blade, each said link being connected to one of said members remote from said pivot axis of the associated blade, said links limiting the pivoting movement of said blades about said blade pivot axis, whereby movement of said members relative to said blades will alter the limits of movements of said trailing edges of said blades relative to said surface which is defined by the leading edges of said blades.

32. A sail assembly as claimed in claim 31 wherein said links are flexible but substantially inextensible.

33. A sail assembly as claimed in claim 31 wherein part of said links are coincident with the adjacent blades.

34. A sail assembly as claimed in claim 29 wherein part of the member securement means is coincident with at least one of said blades.

35. A waterborne sailing vessel comprising:

(a) a frame including two elongated aft struts, an elongated forward strut and an elongated mast, each of said struts having a juncture end, a distal end, and a distal end region adjacent the distal end, connecting means for attaching said juncture ends to one another to form a common juncture so that said struts project outwardly and downwardly from said juncture, said mast projects upwardly from said juncture and the distal ends of said struts and said mast define the verticies of a tetrahedron, said frame also including stay means for connecting the distal end region of said mast to the distal end regions of each of said struts and for connecting the distal end region of said forward strut to the distal end regions of each of said aft struts, (b) A forward pontoon and two aft pontoons, and pontoon connecting means for connecting said forward and aft pontoons to the distal end regions of said forward and aft struts, respectively;

(c) an elongated, substantially rigid crossbeam having opposite ends and end regions adjacent thereto;

(d) crossbeam connecting means for connecting the end regions of said crossbeam to said aft struts; and (e) a means for securing a propulsion means to the region of the vessel which includes said forward pontoon and distal end region of said forward strut.

36. A vessel as claimed in claim 35 wherein said propulsion means comprises at least one outboard motor.

* * * * *